US005240589A

United States Patent [19]

Bartak et al.

[11] Patent Number: 5,240,589

[45] Date of Patent: Aug. 31, 1993

[54] TWO-STEP CHEMICAL/ELECTROCHEMICAL PROCESS FOR COATING MAGNESIUM ALLOYS

[75] Inventors: Duane E. Bartak, Grand Forks, N. Dak.; Brian E. Lemieux, East Grand Forks, Minn.; Earl R. Woolsey, Grand Forks, N. Dak.

[73] Assignee: Technology Applications Group, Inc., Grand Forks, N. Dak.

[21] Appl. No.: 918,946

[22] Filed: Jul. 22, 1992

Related U.S. Application Data

[63] Continuation of Ser. No. 661,503, Feb. 26, 1991, abandoned.

[51] Int. Cl.[5] ..... C25D 11/30

[52] U.S. Cl. ..... 205/321; 205/210; 205/198

[58] Field of Search ..... 205/321, 210, 198

[56] References Cited

U.S. PATENT DOCUMENTS

| | | | |
|---|---|---|---|
| 1,574,289 | 2/1926 | Keeler | 205/321 |
| 2,313,754 | 3/1943 | Loose | 205/321 |
| 2,723,952 | 11/1955 | Evangelides | 204/35 |
| 2,766,199 | 10/1956 | Higgins | 204/141 |
| 2,880,148 | 3/1959 | Evangelides | 204/35 |
| 2,901,409 | 8/1959 | De Long | 204/56 |
| 3,345,276 | 10/1967 | Munroe | 204/32 |
| 3,732,152 | 5/1973 | Hawke | 204/56 |
| 3,791,942 | 2/1974 | McNeill | 204/56 |
| 3,832,293 | 8/1974 | Hradcovsky et al. | 204/56 |
| 3,834,999 | 9/1974 | Hradcovsky et al. | 205/321 |
| 3,956,080 | 5/1976 | Hradcovsky et al. | 205/321 |
| 4,184,926 | 1/1980 | Kozak | 205/321 |
| 4,620,904 | 11/1986 | Kozak | 205/321 |
| 4,659,440 | 4/1987 | Hradcovsky | 205/321 |
| 4,668,347 | 5/1987 | Habermann et al. | 205/321 |
| 4,744,872 | 5/1988 | Kobayashi et al. | 205/321 |
| 4,978,432 | 12/1990 | Schmeling et al. | 204/58.4 |

FOREIGN PATENT DOCUMENTS

| | | |
|---|---|---|
| 58-1093 | 1/1983 | Japan . |
| 58-1094 | 1/1983 | Japan . |
| 62-33783 | 2/1987 | Japan . |
| 62-70600 | 4/1987 | Japan . |
| 63-29000 | 6/1988 | Japan . |
| 63-44839 | 9/1988 | Japan . |
| 63-277793 | 11/1988 | Japan . |

*Primary Examiner*—John Niebling
*Assistant Examiner*—Kishor Mayekar
*Attorney, Agent, or Firm*—Merchant, Gould, Smith, Edell, Welter & Schmidt

[57] ABSTRACT

A two-step process for the coating of magnesium and its alloys is disclosed. The first step comprises immersing the magnesium workpiece in an aqueous solution comprising about 0.2 to 5 molar ammonium fluoride having a pH of about 5 to 8 and a temperature of about 40° to 100° C. The second step is an electrochemical treatment of the pretreated article in an aqueous electrolytic solution having a pH of at least about 12.5 and which solution comprises about 2 to 12 g/L of a aqueous soluble hydroxide, about 2 to 15 g/L of a fluoride-containing composition selected from the group consisting of fluorides and fluorosilicates, and about 5 to 30 g/L of a silicate. This process results in a superior coating which has increased abrasion and corrosion resistance.

22 Claims, 2 Drawing Sheets

TWO-STEP CHEMICAL/ELECTROCHEMICAL PROCESS FOR COATING MAGNESIUM ALLOYS

This is a continuation, of application Ser. No. 07/661,503, filed Feb. 26, 1991, which was abandoned upon the filing hereof.

FIELD OF THE INVENTION

The invention relates to a process for forming an inorganic coating on a magnesium alloy and to a product formed by this process. In particular, the invention relates to a method comprising pretreating an article comprising a magnesium alloy in a chemical bath at a neutral pH followed by an electrolytically coating the pretreated article in an aqueous solution.

BACKGROUND OF THE INVENTION

The use of magnesium in structural applications is growing rapidly. Magnesium is generally alloyed with any of aluminum, manganese, thorium, lithium, tin, zirconium, zinc, rare earth metals or other alloys to increase its structural stability. Such magnesium alloys are often used where a high strength to weight ratio is required. The appropriate magnesium alloy can also offer the highest strength to weight ratio of the ultra light metals at elevated temperatures. Further, alloys with rare earth or thorium can retain significant strength up to temperatures of 315° C. and higher. Structural magnesium alloys may be assembled in many of the conventional manners including riveting and bolting, arc and electric resistance welding, braising, soldering and adhesive bonding. The magnesium-containing articles have uses in the aircraft and aerospace industries, military equipment, electronics, automotive bodies and parts, hand tools and in materials handling. While magnesium and its alloys exhibit good stability in the presence of a number of chemical substances, there is a need to further protect the metal, especially in acidic environments and in salt water conditions. Therefore, especially in marine applications, it is necessary to provide a coating to protect the metal from corrosion.

There are many different types of coatings for magnesium which have been developed and used. The most common coatings are chemical treatments or conversion coatings which are used as a paint base and provide some corrosion protection. Both chemical and electrochemical methods are used for the conversion of magnesium surfaces. Chromate films are the most commonly used surface treatment for magnesium alloys. These films of hydrated, gel-like structures of polychromates provide a surface which is a good paint base but which provides limited corrosion protection.

Anodization of magnesium alloys is an alternative electrochemical approach to provide a protective coating. At least two low voltage anodic processes, Dow 17 and HAE, have been commercially employed. However, the corrosion protection provided by these treatments remains limited. The Dow 17 process utilizes potassium dichromate, a chromium (VI) compound, which is acutely toxic and strictly regulated. Although the key ingredient in the HAE anodic coating is potassium permanganate, it is necessary to use a chromate sealant with this coating in order to obtain acceptable corrosion resistance. Thus in either case, chromium (VI) is necessary in the overall process in order to achieve a desirable corrosion resistant coating. This use of chromium (VI) means that waste disposal from these processes is a significant problem.

More recently, metallic and ceramic-like coatings have been developed. These coatings may be formed by electroless or electrochemical processes. The electroless deposition of nickel on magnesium and magnesium alloys using chemical reducing agents in coating formulation is well known in the art. However, this process also results in the creation of large quantities of hazardous heavy metal contaminated waste water which must be treated before it can be discharged. Electrochemical coating processes can be used to produce both metallic and nonmetallic coatings. The metallic coating processes again suffer from the creation of heavy metal contaminated waste water.

Non-metallic coating processes have been developed, in part, to overcome problems involving the heavy metal contamination of waste water. Kozak, U.S. Pat. No. 4,184,926, discloses a two-step process for forming an anti-corrosive coating on magnesium and its alloys. The first step is an acidic chemical pickling or treatment of the magnesium work piece using hydrofluoric acid at about room temperature to form a fluoro-magnesium layer on the metal surface. The second step involves the electrochemical coating of the work piece in a solution comprising an alkali metal silicate and an alkali metal hydroxide. A voltage potential from about 150–300 volts is applied across the electrodes, and a current density of about 50–200 mA/cm$^2$ is maintained in the bath. The first step of this process is a straight forward acid pickling step, while the second step proceeds in an electrochemical bath which contains no source of fluoride. Tests of this process indicate that there is a need for increased corrosion resistance and coating integrity.

Kozak, U.S. Pat. No. 4,620,904, discloses a one-step method of coating articles of magnesium using an electrolytic bath comprising an alkali metal silicate, an alkali metal hydroxide and a fluoride. The bath is maintained at a temperature of about 5° -70° C. and a pH of about 12–14. The electrochemical coating is carried out under a voltage potential from about 150–400 volts. Tests of this process also indicates that there remains a need for increased corrosion resistance.

Based on the teachings of the prior art, a process for the coating of magnesium-containing articles is needed which results in a uniform coating with increased corrosion resistance. Further, a more economical coating process is needed which has reduced apparatus demands and which does not result in the production of heavy metal contaminated waste water.

SUMMARY OF THE INVENTION

The present invention is directed to a process for coating a magnesium-containing article. The article is pretreated in an aqueous solution comprising about 0.2 to 5 molar ammonium fluoride having a pH of about 5 to 8 and a temperature of about 40° to 100° C. This pretreatment step cleans the article and creates an ammonium fluoride-containing layer at the surface of the article to form a pretreated article. Next, the pretreated article is immersed in an aqueous electrolytic solution having a pH of at least about 12.5 and which solution comprises about 2 to 12 g/L of a aqueous soluble hydroxide, about 2 to 15 g/L of a fluoride-containing composition selected from the group consisting of fluorides and fluorosilicates, and about 5 to 30 g/L of a silicate. A voltage differential of at least about 100 volts is established between an anode comprising the pretreated article and a cathode also in contact with the electrolytic solution to create a current density of about 2 to 90 mA/cm$^2$. Through this process, a silicon oxide-containing coating is formed on the magnesium-containing article.

The term "magnesium-containing article", as used in the specification and the claims, means a metallic article having surfaces which are in whole or in part metallic magnesium per se or a magnesium alloy. Preferably, the article is formed of metallic magnesium or a magnesium alloy and comprises a significant amount of magnesium. More preferably, the article comprises a magnesium-rich alloy comprising at least about 50 wt-% magnesium, and most preferably, the article comprises at least about 80 wt-% magnesium.

DETAILED DESCRIPTION OF THE PREFERRED EMBODIMENT

Figure 1:
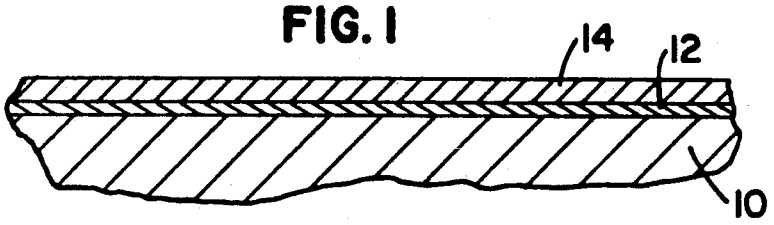
FIG. 1 illustrates the coated magnesium-containing article of the invention.

FIG. 1 illustrates a cross section of a magnesium-containing article having been coated using the process of the present invention. The magnesium-containing article 10 is shown with a first ammonium fluoride-containing layer 12 and a second ceramic-like layer 14. The layers 12 and 14 combine to form a corrosion resistant coating on the surface of the magnesium-containing article.

Figure 2:
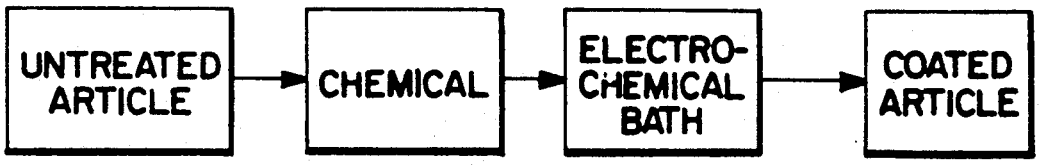
FIG. 2 is a block diagram of the present invention.

Coatings include ceramic-like, silicon oxide containing coatings. FIG. 2 illustrates the steps used to produce these coated articles. An untreated article 20 is first placed in a chemical bath 22 which cleans and forms an ammonium fluoride-containing layer on the article. Next, the article is treated in an electrochemical bath 24 resulting in the production of a coated article 26.

The chemical bath 22 comprises an aqueous ammonium fluoride solution. Preferably, the bath comprises 0.2 to 5 molar ammonium fluoride in water, more preferably, 0.3 to 2.0 molar ammonium fluoride and, most preferably, about 0.5 to 1.2 molar ammonium fluoride. The reaction conditions are indicated below in Table I.

TABLE I

| Condition | Preferred | More Preferred | Most Preferred |
|---|---|---|---|
| pH | 4–8 | 5–7 | 6–7 |
| Temperature (°C.) | 40–100 | 55–90 | 70–85 |
| Time (minutes) | 15–60 | 30–45 | 30–40 |

If the bath is too acidic or too hot, too vigorous of an oxidation (etching) reaction occurs, and if the bath is too alkaline or too cool, the reaction proceeds too slowly for practical production of coated articles.

The magnesium-containing article is maintained in the chemical bath for a time sufficient to clean impurities at the surface of the article and to form an ammonium fluoride-containing base layer on the magnesium-containing article. This results in the production of a magnesium-containing article which is coated with a predominately metal ammonium fluoride and/or metal ammonium oxofluoride containing layer, most of the metal being magnesium depending on the nature of the alloy. Too brief a residence time in the chemical bath results in an insufficient fluoride containing base layer and/or insufficient cleaning of the magnesium-containing article. This will ultimately result in the reduced corrosion resistance of the coated article. Longer residence times tend to be uneconomical as the process time is increased with little improvement of the base layer. This base layer is generally uniform in composition and thickness across the surface of the article and provides an excellent base upon which a second, ceramic-like layer may be deposited. Preferably, the thickness of this fluoride containing layer is about 1 to 2 microns.

While we do not wish to be confined to this theory, it appears that the first chemical bath is beneficial as it provides a base layer which firmly bonds to and protects the substrate, which is compatible with the composition which will form the second layer and which adheres the second layer to the substrate. It appears that the base layer comprises metal ammonium fluorides and oxofluorides which strongly adhere to the metallic substrate. It appears that the compatibility of these compounds with those of the second layer permits the deposition of silicon oxide, among other compounds, in a uniform manner without appreciable etching of the metal substrate.

This base layer provides some protection to the metallic substrate, but it does not provide the abrasion resistance and hardness that the complete, two-layered coating provides. On the other hand, if the silicon oxide-containing layer is applied to the metallic substrate without first depositing the base layer, the corrosion and abrasion resistance of the coating is reduced as the silicon oxide-containing layer does not adhere well to the substrate.

Between the chemical bath 22 and the electrochemical bath 24, the pretreated article is preferably thoroughly washed with water to remove any unreacted ammonium fluoride. This cleaning prevents the contamination of the electrochemical bath 24.

Figure 3:
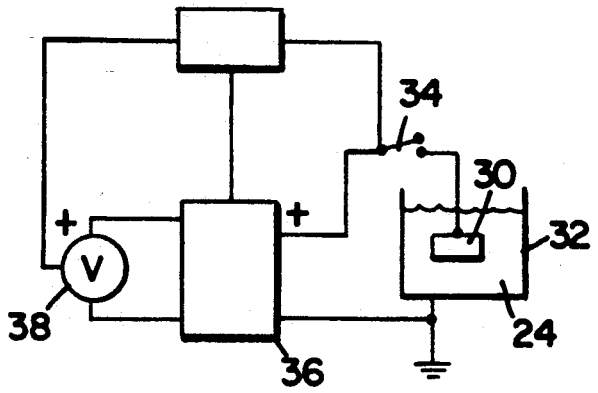
FIG. 3 is a diagram of the electrochemical process of the invention.

The cleaned, pretreated article is then subjected to an electrochemical coating process shown in FIG. 3. The electrochemical bath 26 comprises an aqueous electrolytic solution comprising about 2 to 12 g/L of a soluble hydroxide compound, about 2 to 15 g/L of a soluble fluoride-containing compound selected from the group consisting of fluorides and fluorosilicates and about 5 to 30 g/L of a silicate. Preferred hydroxides include alkali metal hydroxides. More preferably, the alkali metal is lithium, sodium or potassium, and most preferably, the hydroxide is potassium hydroxide.

The fluoride-containing compound may be a fluoride such as an alkali metal fluoride, such as lithium, sodium and potassium fluoride or an acid fluoride such as hydrogen fluoride or ammonium bifluoride. Fluorosilicates such as potassium fluorosilicate or sodium fluorosilicate may also be used. Preferably, the fluoride-containing compound comprises an alkali metal fluoride, an alkali metal fluorosilicate, hydrogen fluoride or mixtures thereof. Most preferably, the fluoride-containing compound comprises potassium fluoride.

The electrochemical bath also contains a silicate. Useful silicates include alkali metal silicates and/or alkali metal fluorosilicates. More preferably, the silicate comprises lithium, sodium or potassium silicate, and most preferably, the silicate is potassium silicate.

Composition ranges for the aqueous electrolytic solution are shown below in Table II.

TABLE II

| Component | Preferred | More Preferred | Most Preferred |
|---|---|---|---|
| Hydroxide | 2-12 g/L | 4-8 g/L | 5-7 g/L |
| Fluoride | 2-15 g/L | 3-10 g/L | 8-10 g/L |
| Silicate | 5-30 g/L | 10-25 g/L | 15-20 g/L |

The pretreated article 30 is immersed in the electrochemical bath 24 as an anode. The vessel 32 which contains the electrochemical bath 24 may be used as the cathode. The anode may be connected through a switch 34 to a rectifier 36 while the vessel 32 may be directly connected to the rectifier 36. The rectifier 36, rectifies the voltage from a voltage source 38, to provide a direct current source to the electrochemical bath. The rectifier 36 and switch 34 may be placed in communication with a microprocessor control 40 for purposes of controlling the electrochemical composition. Preferably, the rectifier provides a pulsed DC signal to drive the deposition process.

The conditions of the electrochemical deposition process are preferably as illustrated below in Table III.

TABLE III

| Component | Preferred | More Preferred | Most Preferred |
|---|---|---|---|
| pH | 12-14 | 12-13 | 12.5-13 |
| Temperature (°C.) | 5-30 | 10-25 | 10-20 |
| Time (minutes) | 5-80 | 15-60 | 20-30 |
| Current Density ($mA/cm^2$) | 2-90 | 5-70 | 10-50 |

These reaction conditions allow the formation of a ceramic-like coating of up to about 40 microns in about 80 minutes or less. Maintaining the voltage differential for longer periods of time will allow for the deposition of thicker coatings. However, for most practical purposes, coatings of about 10 to 30 microns in thickness are preferred and can be obtained through a coating time of about 10 to 30 minutes.

Coatings produced according to the above-described process are ceramic-like and have excellent corrosion and abrasion resistance and hardness characteristics. While not wishing to be held to this theory, it appears that these properties are the result of the morphology and adhesion of the coating on the metal substrate. The preferred coatings comprise a mixture of fused silicon oxide and fluoride along with an alkali metal oxide.

The adhesion of the coating of the invention appears to perform considerably better than any known commercial coatings. This is a result of a coherent interface between the metal substrate and the coating. By coherent interface, it is meant that the interface comprises a continuum of magnesium, magnesium oxides, magnesium oxofluorides, magnesium fluorides and silicon oxides.

Figure 4:
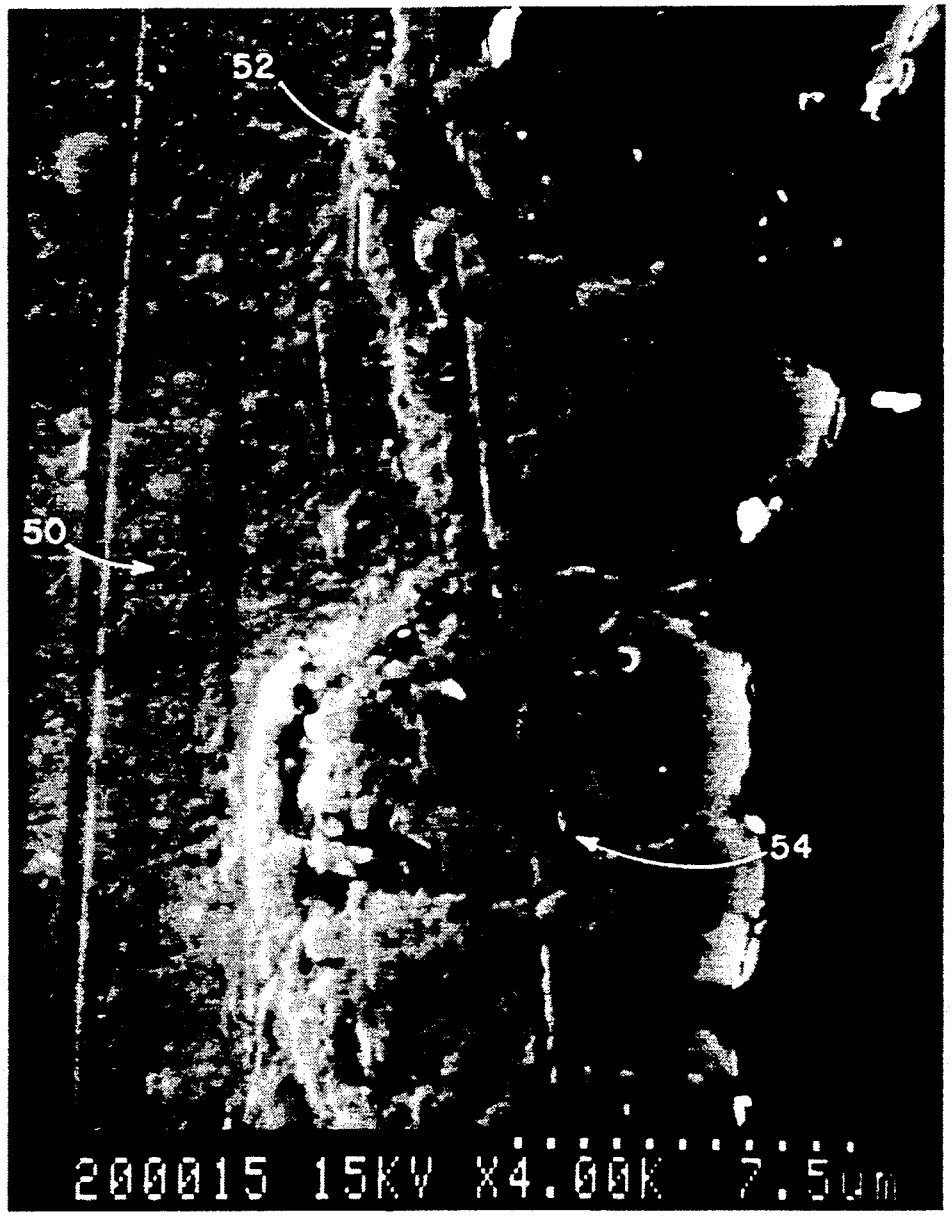
FIG. 4 is a scanning electron photomicrograph of a cross section through the magnesium-containing substrate and a coating according to the invention.

The continuous interface is shown in FIG. 4, a scanning electron photomicrograph. The metal substrate 50 has an irregular surface, and an interfacial boundary comprising an ammonium fluoride-containing base layer 52 is formed at the surface of the substrate 50. The silicon oxide-containing layer 54 formed on the base layer 52 shows excellent integrity, and both coating layers 52 and 54 therefore provide a superior corrosion and abrasion resistant surface.

Abrasion resistance can be measured according to Federal Test Method Std. No. 141C, Method 6192.1. Preferably, coatings produced according to the invention having a thickness of 0.5 to 1.0 mil will withstand at least about 1,000 wear cycles before the appearance of the bare metal substrate using a 1.0 kg load on a CS-17 abrading wheel. More preferably, the coatings will withstand at least about 2,000 wear cycles before the appearance of the metal substrate, and most preferably, the coatings will withstand at least about 4,000 wear cycles using a 1.0 kg load on a CS-17 abrading wheel.

Corrosion resistance can be measured according to ASTM standards. Included in these tests is the salt fog test, ASTM B117, as evaluated by ASTM D1654, procedures A and B. Preferably, as measured according to procedure B, coatings produced according to the invention achieve a rating of at least about 9 after 24 hours in salt fog. More preferably, the coatings achieve a rating of at least about 9 after 100 hours, and most preferably, at least about 9 after 200 hours in salt fog.

After the magnesium-containing articles have been coated according to the present process, they may be used as is, offering a superb finish and excellent corrosion resistant properties, or they may be further coated using an optional finish coating such as a paint or a sealant. The structure and morphology of the silicon oxide-containing coating readily permit the use of a wide number of additional finish coatings which offer further corrosion resistance or decorative properties to the magnesium containing articles. Indeed, the silicon oxide-containing coating provides an excellent paint base having excellent corrosion resistance and offering excellent adhesion under both wet and dry conditions, for instance, the water immersion test, ASTM D3359, test method B. The optional finish coatings may include organic and inorganic compositions as well as paints and other decorative and protective organic coatings. Any paint which adheres well to glassy and metallic surfaces may be used as the optional finish coating. Representative, non-limiting inorganic compositions for use as an outer coating include additional alkali metal silicates, phosphates, borates, molydates and vanadates. Representative, non-limiting organic outer coatings include polymers such as polyfluoroethylene, polyurethane and polyglycol. Additional finish coating materials will be known to those skilled in the art. Again, these optional finish coatings are not necessary to obtain excellent corrosion resistance, their use may achieve decorative or further improve the protective qualities of the coating.

Excellent corrosion resistance occurs after further application of an optional finish coating. Preferably, as measured according to procedure B, coatings produced according to the invention, having an optional finish coating, achieve a rating of at least about 8 after 700 hours in salt fog. More preferably, the coatings achieve a rating of at least about 9 after 700 hours, and most preferably, at least about 10 after 700 hours in salt fog.

EXAMPLES

The following specific examples, which contain the best mode, can be used to further illustrate the invention. These examples are merely illustrative of the invention and do not limit its scope.

EXAMPLE I

Magnesium test panels (AZ91D) were cleaned immersing them in an aqueous solution of sodium pyrophosphate, sodium borate and sodium fluoride at about 70° C. and a pH of about 10.5 for about 5 minutes. The panels were then placed in a 0.5M ammonium fluoride bath at 70° for 30 minutes. The panels were then rinsed and placed in a silicate-containing bath. The silicate bath was prepared by first dissolving 50 g potassium hydroxide in 10 L water. 200 milliliters of a commercially available potassium silicate concentrate (20% w/w $SiO_2$) was then added to the above solution. Finally 50 g of potassium fluoride was added to the above solution. The bath then has a pH of about 12.5 and a concentration of potassium hydroxide about 5 g/L, about 16 g/L potassium silicate and about 5 g/L potassium fluoride. The panels were then placed in the bath and connected to the positive lead of a rectifier. A stainless steel panel served as the cathode and was connected to the negative lead of the rectifier capable of delivering a pulsed DC signal. The voltage was increased over a 30 second period to 150 V and then the current adjusted to sustain a current density of 30 mA/cm$^2$. After 30 minutes, the silicon oxide-containing coating was approximately 20 microns thick.

EXAMPLES II-VIII

Examples II-VIII were prepared according to the process of Example I with the quantities of components as shown in Tables IV and V below.

TABLE IV

| | Chemical Bath | | |
|---|---|---|---|
| Example | $NH_4F$ Concentration (M) | Bath Time (°C.) | Residence Time (min) |
| II | 1.0 | 70 | 30 |
| III | 1.5 | 60 | 30 |
| IV | 0.7 | 80 | 30 |
| V | 1.0 | 80 | 20 |
| VI | 1.0 | 70 | 30 |
| VII | 0.8 | 80 | 40 |
| VIII | 1.2 | 60 | 30 |

TABLE V

| | Electrochemical Bath (10 L) | | | | | | |
|---|---|---|---|---|---|---|---|
| Example | Hydroxide | Potassium Silicate Concentrate* | Fluoride | Bath Temp. (°C.) | pH | Current Density (mA/cm$^2$) | Resid. Time (min) |
| II | 60 g KOH | 300 ml | 150 g KF | 20 | 12.8 | 40 | 30 |
| III | 70 g KOH | 200 ml | 100 g NAF | 20 | 12.9 | 60 | 25 |
| IV | 60 g NaOH | 250 ml | 100 g NaF | 20 | 12.9 | 80 | 15 |
| V | 40 g LiOH | 200 ml | 100 g KF | 20 | 12.8 | 20 | 40 |
| VI | 50 g NaOH | 300 ml | 80 g NaF | 20 | 12.9 | 50 | 30 |
| VII | 60 g KOH | 200 ml | 100 g KF | 20 | 12.9 | 30 | 40 |
| VIII | 30 g KOH/ 10 g LiOH | 250 ml | 120 g KF | 20 | 12.9 | 20 | 30 |

*(20% w/w $SiO_2$ in water)

Abrasion resistance testing (141C) of these test panels resulted in wear cycles of at least about 2,000 before the appearance of the metal substrate using a 1.0 kg load on CS-17 abrading wheels.

EXAMPLE IX

A magnesium test panel was coated as in Example I. Upon drying, an optional coating was applied in the following manner. The panel was immersed in a 12% solution of potassium hydrogen phosphate (pH=7.2) for five (5) minutes at 60° C. The panel was rinsed and dried and subjected to salt fog ASTM B117 testing. The panel achieved a rating of 10 after 700 hours in salt fog.

EXAMPLE X

Test panels coated according to Examples I and IX were primed with an acid catalyst primer and then painted with a high temperature enamel. The panels were then immersed in water for four (4) days at 100° F. and subjected to ASTM D3359, method B. The panels achieved a rating of 5/5, the highest possible rating as no flaking of the coatings could be observed.

The foregoing description, Examples and data are illustrative of the invention described herein, and they should not be used to unduly limit the scope of the invention or the claims. Since many embodiments and variations can be made while remaining within the spirit and scope of the invention, the invention resides wholly in the claims hereinafter appended.

What is claimed is:

1. A process for forming an improved corrosion resistant coating on a magnesium-containing article, which process comprises:

(a) treating the article with a first aqueous solution, at a pH of about 5 to 8 and a temperature of about 40° to 100° C., which solution comprises about 0.2 to 5 molar ammonium fluoride to create a metal ammonium fluoride-containing layer on the article to form a pretreated article;

(b) placing the pretreated article into a second aqueous solution having a pH of at least about 12.5 which comprises:

(i) about 2 to 12 g/L of an aqueous soluble hydroxide;

(ii) about 2 to 15 g/L of an aqueous soluble fluoride-containing composition selected from the group consisting of fluorides, fluorosilicates, and mixtures thereof; and (iii) about 5 to 30 g/L of an alkali metal silicate;

(c) establishing a voltage differential between an anode comprising the pretreated article and a cathode in the second solution of at least about 100 volts to create a current density of about 2 to 90 mA/cm$^2$;

wherein a silicon oxide-containing coating is formed on the article.

2. The process of claim 1 wherein the pH of step (a) is about 6.3 to 6.7.

3. The process of claim 1 wherein the temperature of the first solution is about 55° to 85° C.

4. The process of claim 1 comprising about 0.3 to 2.0 molar ammonium fluoride.

5. The process of claim 1 wherein the pH of step (b) is about 12.5 to 13.

6. The process of claim 1 wherein the hydroxide of step (b) is an alkali metal hydroxide.

7. The process of claim 1 wherein the fluoride-containing composition of step (b) is selected from the group consisting of sodium fluoride, potassium fluoride, hydrofluoric acid, lithium fluoride, rubidium fluoride, cesium fluoride and a mixture thereof.

8. The process of claim 1 wherein the fluorosilicate of step (b) is selected from the group consisting of potassium fluorosilicate, sodium fluorosilicate, lithium fluorosilicate and a mixture thereof.

9. The process of claim 1 wherein the silicate of step (b) is selected from the group consisting of potassium silicate, sodium silicate, lithium silicate, and a mixture thereof.

10. The process of claim 1 wherein the temperature of the second solution is about 5° to 30° C.

11. The process of claim 1 wherein the voltage differential of step (c) is about 200 to 400 volts.

12. The process of claim 1 wherein the current density of step (c) is about 5 to 70 $mA/cm^2$.

13. The process of claim 1 further comprising connecting the anode and cathode to a power source.

14. The process of claim 13 wherein the power source is a rectified alternating current power source.

15. The process of claim 14 wherein the rectified alternating current power source is a pulsed full wave rectified power source.

16. The process of claim 1 further comprising sealing the silicon oxide-containing coating.

17. The process of claim 16 wherein the silicon oxide-containing coating is sealed with an inorganic coating.

18. The process of claim 16 wherein the silicon oxide-containing coating is sealed with an organic coating.

19. The process of claim 1 which process is substantially free of chromium (VI).

20. A magnesium-containing substrate coated according to the process of claim 1.

21. A process which is substantially free of chromium (VI) for forming an improved corrosion resistant coating on a magnesium-containing article, which process comprises:

(a) placing the article into a first aqueous solution having a pH of about 6.5 and a temperature of about 80° C. which comprises about 1 molar ammonium fluoride to create a metal ammonium fluoride-containing layer on the article to form a pretreated article;

(b) placing the pretreated article into a second aqueous solution having a pH of at least about 13 and a temperature of about 20° C. which comprises:

(i) about 6 g/L of a hydroxide;

(ii) about 10 g/L of a fluoride-containing composition selected from the group consisting of fluorides and fluorosilicates; and (iii) about 15 g/L of an alkali metal silicate;

(c) connecting an anode comprising the pretreated article and a cathode to a pulsed, full wave rectified power source;

(d) establishing a voltage differential between the anode comprising the pretreated article and the cathode in the second solution of at least about 150 volts to create a current density of about 40 $mA/cm^2$;

wherein a silicon oxide-containing coating is formed on the article.

22. A process for forming an improved corrosion resistant coating on a magnesium-containing article, which process comprises:

(a) treating the article with a first aqueous solution, at a pH of about 5 to 8 and a temperature of about 40° to 100° C., which solution comprises about 0.2 to 5 molar ammonium fluoride to create a metal ammonium fluoride-containing layer on the article to form a pretreated article;

(b) placing the pretreated article into a second aqueous solution having a pH of at least about 12.5 which comprises:

(i) about 2 to 12 g/L of an aqueous soluble hydroxide; and (ii) about 2 to 30 g/L of an alkali metal fluorosilicate; and (c) establishing a voltage differential between an anode comprising the pretreated article and a cathode in the second solution of at least about 100 volts to create a current density of about 2 to 90 $mA/cm^2$;

wherein a silicon oxide-containing coating is formed on the article.

* * * * *